US006093459A

United States Patent [19]

Puleo, Jr.

[11] Patent Number: 6,093,459

[45] Date of Patent: Jul. 25, 2000

[54] ARTIFICIAL LEAF DECORATIONS AND METHOD OF FORMING SAME

[76] Inventor: Joseph Puleo, Jr., 7 Debra Ct., Scotch Plains, N.J. 07076

[21] Appl. No.: 09/166,810

[22] Filed: Oct. 6, 1998

Related U.S. Application Data

[60] Provisional application No. 60/064,947, Nov. 7, 1997.

[51] Int. Cl.[7] ..... A01N 3/00; A41G 1/00

[52] U.S. Cl. ..... 428/20; 428/19

[58] Field of Search ..... 156/61; 428/15, 428/18, 19, 20, 21, 10, 17

[56] References Cited

U.S. PATENT DOCUMENTS

| | | | |
|---|---|---|---|
| 255,902 | 4/1882 | Wengenroth | 428/18 X |
| 849,363 | 4/1907 | Berry | 428/18 |
| 891,301 | 6/1908 | Spreen | 428/20 |
| 1,689,530 | 10/1928 | Landers | 428/18 X |
| 2,550,023 | 4/1951 | Reilly | 428/20 X |
| 2,893,149 | 7/1959 | Reece et al. | 428/18 X |
| 3,003,623 | 10/1961 | Paul et al. | 428/18 X |
| 3,020,660 | 2/1962 | Scherotto | 428/18 X |
| 3,164,344 | 1/1965 | Whyte | 428/20 X |
| 3,278,364 | 10/1966 | Dieffenbach | 428/18 X |
| 3,459,624 | 8/1969 | Baus et al. | 428/18 |
| 3,463,696 | 8/1969 | Baus et al. | 428/18 |
| 3,499,818 | 3/1970 | Kent | 428/18 |
| 3,574,102 | 4/1971 | Hermanson | 428/20 X |
| 3,616,102 | 10/1971 | Baus et al. | 428/20 |
| 3,616,107 | 10/1971 | Kershner | 428/20 X |
| 3,676,275 | 7/1972 | Sloane | 428/19 X |
| 3,735,117 | 5/1973 | Hunt | 428/18 X |
| 4,248,916 | 2/1981 | Chase | 428/20 X |
| 4,496,615 | 1/1985 | Huang | 428/20 X |
| 4,517,230 | 5/1985 | Crawford | 428/91 X |
| 4,774,113 | 9/1988 | Shaffer | 428/18 |
| 4,805,075 | 2/1989 | Damore | 428/20 X |
| 5,054,622 | 10/1991 | Lee | 428/18 X |
| 5,215,793 | 6/1993 | Osment et al. | 428/18 |
| 5,306,366 | 4/1994 | Shattan | 428/18 X |
| 5,401,545 | 3/1995 | Hyde | 428/18 |

*Primary Examiner*—Deborah Jones
*Assistant Examiner*—Wendy Boss
*Attorney, Agent, or Firm*—Lerner, David, Littenberg, Krumholz & Mentlik, LLP

[57] ABSTRACT

Artificial trees and wreathes are constructed from a plurality of artificial leaves having shape memory characteristics. The leaves are constructed from twisted wires of plastic material which capture elongated strips providing the thistles for the leaves. The shape memory characteristics enable the leaves to return to their original orientation after being distorted from storage in a carton either during shipping or between use.

34 Claims, 4 Drawing Sheets

ARTIFICIAL LEAF DECORATIONS AND METHOD OF FORMING SAME

This application claims the benefit of Provisional Application No. 60/064,947 filed on Nov. 7, 1997.

BACKGROUND OF THE INVENTION

The present invention relates in general to artificial leaf decorations such as artificial trees, artificial wreathes and the like, and method of forming same. More particularly, the present invention relates to such artificial trees and artificial wreathes which include a plurality of branches to which there are attached a plurality of artificial leaves possessing shape memory characteristics, e.g., returning to their desired orientation and shape after initial manufacture or after being removed from their packaging where the leaves are often crushed during repackaging, transport and/or storage.

Artificial leaf decorations have been widely used for decorative and display purposes both in the home and in the merchandising industry. For example, artificial trees simulating the configuration of the familiar evergreen tree or conifer universally used as a Christmas tree have enjoyed widespread popularity. One such artificial tree is known from Shaffer, U.S. Pat. No. 4,774,113 which discloses the tree branches being constructed from a plurality of artificial leaves formed by twisting together a pair of metal wires to entrap a filament therebetween forming thistles. Hunt, U.S. Pat. No. 3,735,117 discloses an artificial Christmas tree formed from a trunk having side branches integral therewith and twigs having thistles all of plastic material. Baus, et al., U.S. Pat. No. 3,459,624 discloses an artificial Christmas tree having leaves formed from twisted metal wires as conventionally known. Each leaf is formed with a bend at one end. In this condition, the bend is inserted radially into a slot within a portion of a branch leaving the terminal ends of the leaf extending outwardly from the branch. Other known constructions of Christmas trees are disclosed in Dieffenbach, U.S. Pat. No. 3,278,364; Reece, et al., U.S. Pat. No. 2,893,149; Baus, et al., U.S. Pat. No. 3,463,696; Landers, U.S. Pat. No. 1,689,530; Hyde, U.S. Pat. No. 5,401,545; and Kent, U.S. Pat. No. 3,499,818.

As artificial leaf decorations are often used seasonally, such as in the case of Christmas trees, there is the requirement that the tree be stored between use. Due to the relatively large volume occupied by fully assembled artificial trees, there is the desirability of constructing these artificial trees to be collapsible, i.e., knock-down, or suitable for removing its branches for compact storage. To this end, there is known from Reece, et al., an artificial tree constructed from a plurality of branches which are removably inserted into a corresponding socket provided within a tree trunk. In Hermanson, U.S. Pat. No. 3,574,102, the individual branches are pivotably attached to the tree trunk to enable their folding into a compact space for storage in a suitable rectangular carton or cylindrical tube.

Owing to the fact that the leaves of the known artificial trees are constructed from twisted metal wires, the leaves become bent, misshaped or positioned out of assembled orientation and/or alignment during storage in its carton either upon purchase or between use by the consumer. In any event, a typical artificial tree may have approximately 4,000 artificial leaves. In order for the assembled artificial tree to have a pleasing, natural and life-like appearance, it is often required that each of the artificial leaves be bent back into its natural position after being stored. Due to the large number of such artificial leaves, the average person will require hours to set up the artificial tree. In addition to being time consuming, this process is often tedious on one's hands which can become sore from manipulating the wire elements which support the leaves thistles.

In Paul, et al., U.S. Pat. No. 3,003,623 there is disclosed the construction of the thistles of a leaf for an artificial Christmas tree which is subject to compressed packing. Each branch of the tree is constructed from a metal rod upon which is helically wrapped a strip of metal foil, such as aluminum. The strip has a continuous, imperforated border along one edge and integral therewith a plurality of fillets of substantially equal width which forms the thistles. Each fillet has a longitudinal medial crimp extending substantially the entire length of the fillet. The medial crimp increases the natural resiliency of the fillet transverse of its length. The branch is initially stored in a cylindrical tube with the fillets in a collapsed condition. As the individual fillets clear the lip of the open end of the tube as the branch is withdrawn, they spring outwardly to assume their normal shape prior to being packed in the tube. The metal rods which form each of the branches are removably secured to a trunk at various angles of inclination to provide a conical configuration simulating a natural tree.

Notwithstanding the aforementioned construction of the thistles, the tree of Paul, et al. has an artificial look. In this regard, the branches are not constructed from individual leaves which are attached thereto. Rather, each branch is wrapped along its entire length with the aforementioned strip of metal foil to provide the thistles formed from the fillets. Accordingly, there is an unsolved need for an artificial leaf decoration such as a tree, wreath and the like, which is constructed from a plurality of individual artificial leaves that are attached to a branch which will return to their original angular orientation after storage and the like without the need for individual manipulation.

SUMMARY OF THE INVENTION

One object of the present invention is to provide an artificial leaf decoration in the form of an artificial tree or artificial wreath and method of forming same which has a natural look.

Another object of the present invention is to provide an artificial leaf decoration and method of forming same which is of knock-down construction by including a plurality of branches which are removably insertable into the trunk.

Another object of the present invention is to provide an artificial tree or artificial wreath and method of forming same which includes a plurality of artificial leaves.

Another object of the present invention is to provide an artificial tree which is fully assembled, of the knock-down type wherein the branches are inserted in a tree trunk and/or where the branches are supported by the tree trunk using a folding hinge.

Another object of the present invention is to provide an artificial tree or artificial wreath and method of forming same which includes a plurality of artificial leaves having shape memory characteristics.

Another object of the present invention is to provide an artificial leaf decoration in the nature of an artificial tree or artificial wreath and method of forming same which enables set up by an unskilled person with a minimum of time.

Another object of the present invention is to provide an artificial leaf decoration in the nature of an artificial tree or artificial wreath and method of forming same which uses synthetic materials such as plastic material in forming the artificial tree components, and in particular, the leaves therefor.

Another object of the present invention is to provide an artificial leaf decoration in the nature of an artificial tree or artificial wreath and method of forming same which provides a greater degree of flexibility in attaching the leaves to the branches to provide a more natural and pleasing look.

The present invention is more specifically directed to artificial Christmas trees and wreaths constructed from a plurality of artificial leaves which are adhered to a branch by wrapping with yarn and the like. Each artificial leaf is constructed by twisting together a pair of plastic wires forming a stem which is intermeshed with a plastic fringe material to provide the thistles. During the manufacturing process, a long length of the twisted plastic wires are cut into short discreet lengths corresponding to the individual leaves, while a heated platten forms a permanent angular deformation or bend in the leaf's stem. A plurality of the artificial leaves are attached to a branch with the leaf's stem set at a predetermined angle to the branch resulting from the bend. During shipping, the artificial leaves are naturally compressed against the branch to minimize the space occupied. Upon withdrawal of the branch from its container, each artificial leaf will automatically return to its original set up position at the permanent angle preset during the manufacturing process. In addition to the use of plastic wire, it is contemplated that spring steel may be used without a bend to enable the leaf to return to its original position, i.e., angular orientation with respect to the branch. This is accomplished by the use of wedge shaped elements which support the leaf on the branch or into which the leaf's stem is inserted at the desired angle. In either event, the artificial leaves possess shape memory characteristics which result in their return to their original set up position after withdrawal of the branches from their container.

In accordance with one embodiment of the present invention there is described an artificial leaf comprising an elongated stem having shape memory characteristics, and a plurality of filaments attached to the stem along the length thereof.

In accordance with another embodiment of the present invention there is described a branch for an artificial leaf decoration, the branch comprising an elongated support member and a plurality of artificial leaves attached along the length of the support member, the artificial leaves comprising an elongated stem having shape memory characteristics, and a plurality of filaments attached to the stem along the length thereof.

In accordance with another embodiment of the present invention there is described an artificial tree comprising an elongated trunk, a plurality of branches attached to the trunk along the length thereof, and a plurality of artificial leaves attached along the length of the branches, the artificial leaves comprising an elongated stem having shape memory characteristics, and a plurality of filaments attached to the stem along the length thereof.

In accordance with another embodiment of the present invention there is described a method of making artificial leaves, the method comprising the steps of providing an elongated strip having a plurality of filaments along the sides thereof, arranging a pair of plastic wires along the strips on opposites sides thereof, twisting the wires along with the strip to form a twisted elongated stem having the filaments extending outwardly therefrom, the stem having shape memory characteristics, and dividing the elongated stem into discreet lengths, each of the discreet lengths comprising an artificial leaf.

BRIEF DESCRIPTION OF THE DRAWINGS

The above description, as well as further objects, features and advantages of the present invention will be more fully understood with reference to the following detailed description of artificial leaf decorations and method of forming same, when taken in conjunction with the accompanying drawings, wherein:

FIG. 6 is a front elevational view showing an artificial leaf having shape memory characteristics so as to return to its original orientation and shape subsequent to being crushed or deformed during storage and the like;

DETAILED DESCRIPTION OF THE PREFERRED EMBODIMENTS

Figure 1:
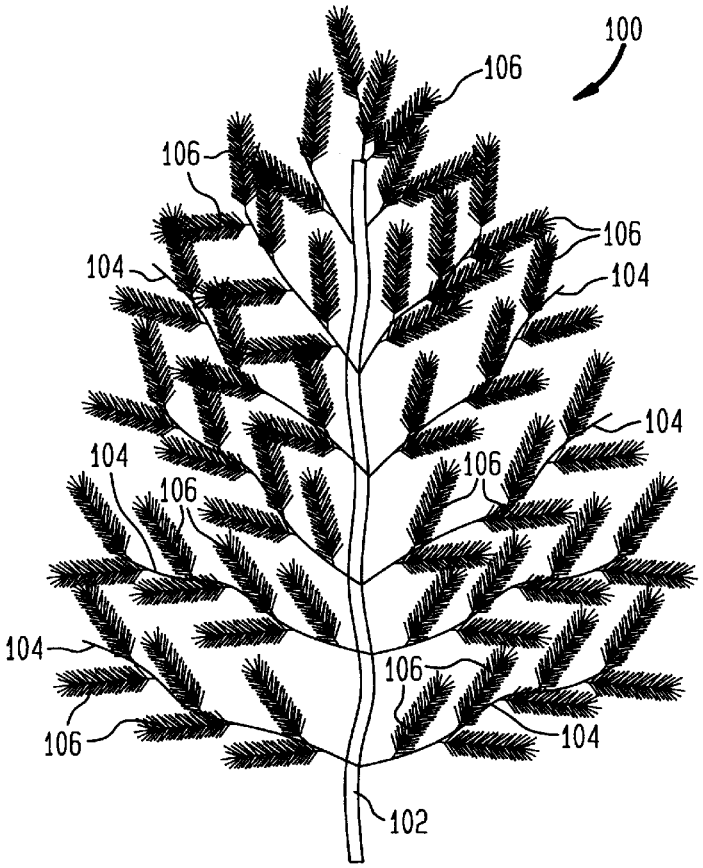
FIG. 1 is a front elevational view of an artificial tree constructed in accordance with one embodiment of the present invention from a plurality of branches to which there are attached a plurality of artificial leaves having shape memory characteristics.

Turning now to the drawings, wherein like reference numerals represent like elements, there is shown in FIG. 1 an artificial leaf decoration in the nature of, for example, an artificial tree constructed in accordance with the present invention and generally designated by reference numeral 100. The artificial tree 100 is constructed from an elongated upright trunk 102 to which there is attached a plurality of branches 104. Each of the branches 104 supports a plurality of artificial leaves 106 constructed in accordance with the present invention. The artificial tree 100 can be constructed in a variety of forms and shapes, as well as being suitable for a variety of ornamental applications. For example, the artificial tree 100 may be constructed in the nature of an artificial Christmas tree for home or merchandising display use. In addition, the artificial tree 100 may be constructed more densely of branches 104 and leaves 106 then illustrated. The specific depiction of the artificial tree 100 has been shown for illustrative purposes only in describing the present invention.

Figure 2:
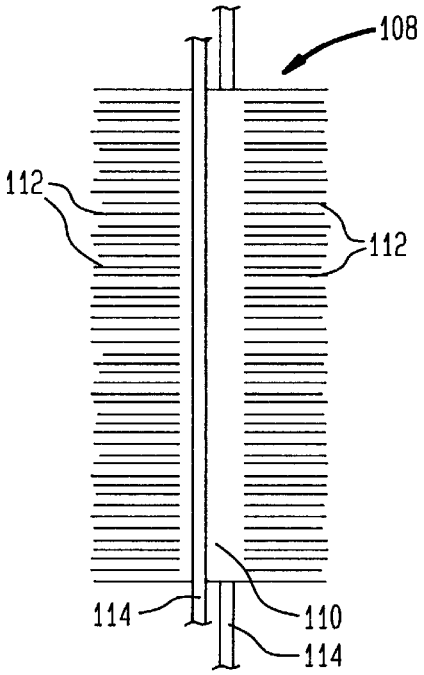
FIG. 2 is a front elevational view of the unassembled components used in the manufacture of an artificial leaf of indeterminate length.

Referring to FIG. 2, the construction of an artificial leaf 106 in accordance with one embodiment of the present invention will now be described. In general, the leaves 106 are initially constructed of indeterminate length which are subsequently cut into discreet leaves for securing to the branches 104. In particular, an elongated continuous strip 108 is provided with an uninterrupted center strip 110 from which there integrally extends on either side thereof a plurality of individual thistles 112. The thistles 112 in the nature of filaments are formed by cutting the strip 108 transverse to its longitudinal axis at a plurality of locations on either side of the center strip 110. The strip 108 can be constructed from a variety of materials, and preferably plastic materials such as polyvinyl chloride (hereinafter PVC) which has fire retardant properties. The strip 108 can be provided in a variety of colors, such as brown, black, dark green or other colored material to simulate an artificial leaf 106 and resulting artificial tree 100. The thistles 112 simulate pine needles to provide the artificial tree 100 with a natural look. The number of thistles 112 and their width may be as desired to provide the particular look sought. In addition, it will be appreciated that other materials can be used for the strip 108, such as metal foils, in particular aluminum, as well as metal coated synthetic plastic material films in order to provide the particular ornamental effect desired.

Figure 3:
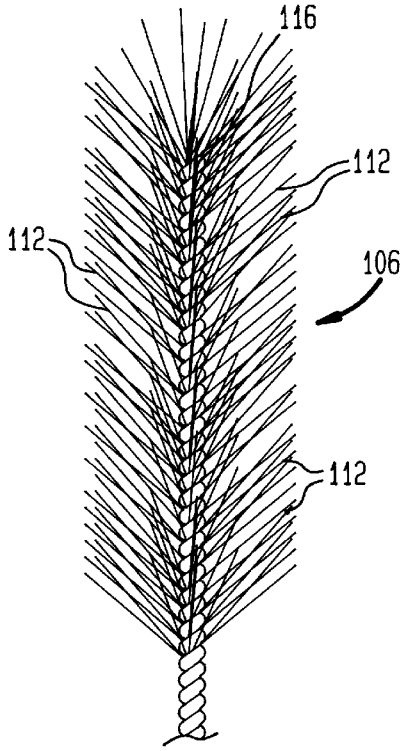
FIG. 3 is a front elevational view of the aforementioned components being assembled to form an artificial leaf of indeterminate length.

A continuous elongated plastic wire 114 is arranged overlying either side of the center strip 110 of the strip 108. The wires 114 may be constructed from a variety of plastic materials, for example, PVC, nylon, polyester, polycarbonates, polyacrylates, polystyrene, polyolefins and the like. In addition, by way of example, the wires 114 may vary in diameter in the range of from about 0.01 to about 0.15 inches. However, this range is merely exemplary, and other diameters both smaller and larger may be used within the scope of the present invention. Using suitable equipment which is well known in the artificial tree manufacturing art, the pair of wires 114 are twisted together to form a continuous helical stem 116 as shown in FIG. 3. As the wires 114 are twisted together, the center strip 110 of the strip 108 is captured therebetween to enable the thistles 112 to extend radially outward from the stem 116 along its length.

As thus far described, the artificial leaves 106 are initially formed as a continuous length from continuous lengths of wires 114 and strips 108 which are twisted together to form the leaf's stem 116. However, it is to be understood that discreet lengths of wires 114 and strips 108 may be used, for example, lengths in the order of ten feet in lieu of continuous components of the leaves 106. It is also contemplated that the stem 116 could be formed from a single untwisted wire 114. In this regard, the thistles 112 would extend only from one side of the center strip 110. The elongated continuous strip 108 would be wrapped about the single wire 114 and secured thereto such as by an adhesive.

Due to the resilient and elastic nature of the stem 116, in one example resulting from its construction from plastic material, the stem has shape memory characteristics. By shape memory characteristics it is meant that the stem 116 upon being bent will return to its original shape upon removal of the bending force. This is to be distinguished from metal wires which, once bent, will remain in their bent shape. A further understanding of the shape memory characteristics of the stem 116 will be evident from the within description of the present invention, in particular, with reference to FIG. 6. Accordingly, the shape memory characteristics of the stem 116 enable the leaves 106 to return to their desired orientation and shape when affixed to the branches 104 after initial manufacture, and thereafter notwithstanding the leaves being crushed, bent or otherwise deformed during packaging, shipping and/or storage between use.

Figure 4:
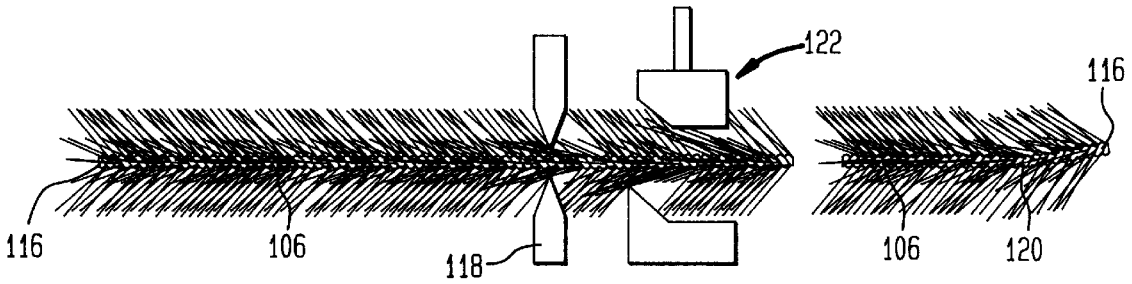
FIG. 4 is a diagrammatic illustration of an artificial leaf of indeterminate length being divided into individual leaves having a preset angular bend along a portion thereof.

Referring now to FIG. 4, a continuous leaf 106 is divided into individual leaves 106 by severing the stem 116 at predetermined lengths by use of a cutting device 118. The cutting device 118 may be any suitable device which is operative for cutting the stem 116. The particular length of the individual leaves 106 may be predetermined prior to construction of the artificial tree 100. As such, the individual leaves 106 may be of the same or varying length to provide the artificial tree 100 with the desired shape and appearance.

In accordance with one embodiment, the discreet leaves 106 are formed with a permanent bend 120 within the stem 116 adjacent one end thereof. The permanent bend 120 is formed by, for example, the use of a heated die and platten device generally designated by reference numeral 122. The die and platten device is operative for heating a portion of the stem 116 generally to at least the glass transition temperature of the plastic material. Under the action of heat and pressure by the die and platten device 122, the permanent bend 120 may be formed in the stem 116. The angle of the permanent bend 120 may be any angle desired by the user to provide the artificial tree 100 with the desired shape and appearance. However, as will be appreciated from the further understanding of the present invention, permanent bends 120 of other angles than those illustrated in the drawings may be incorporated in the artificial leaves 106 constructed in accordance with the present invention. As a result of the heat and pressure applied by the die and platten device 122, the permanent bend 120 will remain in the stem 116, notwithstanding the shape memory characteristics of the stem.

Figure 5:
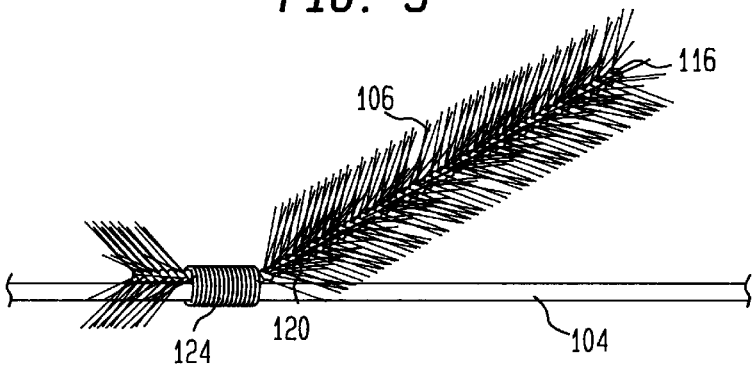
FIG. 5 is a front elevational view showing the attachment of an artificial leaf to a branch in accordance with one embodiment of the present invention.

Turning now to FIG. 5, a plurality of discreet artificial leaves 106 are attached to a branch 104 using a wrapping 124, only one such leaf being shown. By way of example, the wrapping 124 is in the nature of a continuous strip of plastic material, such as PVC or other suitable plastic material. The wrapping 124, like the strip 108, can be provided in a variety of colors, such as brown, black, dark green or other colored material to simulate an artificial leaf 106 and resulting artificial tree 100.

Generally, the short segment of the stem 106 adjacent the permanent bend 120 is positioned against the branch 104. This causes the longer portion of the stem 116 to extend outwardly away from the branch 104 at the angle preset by the permanent bend 120. As previously described, this angle may be the same or different from artificial leaf 106 to artificial leaf as may be desired to create the particular ornamental look and shape of the artificial tree 100. The short segment of the stem 116 is secured to the branch 104 by use of the wrapping 124 which is tightly wound thereabout to generally conceal the short segment of the stem 116.

Figure 6:
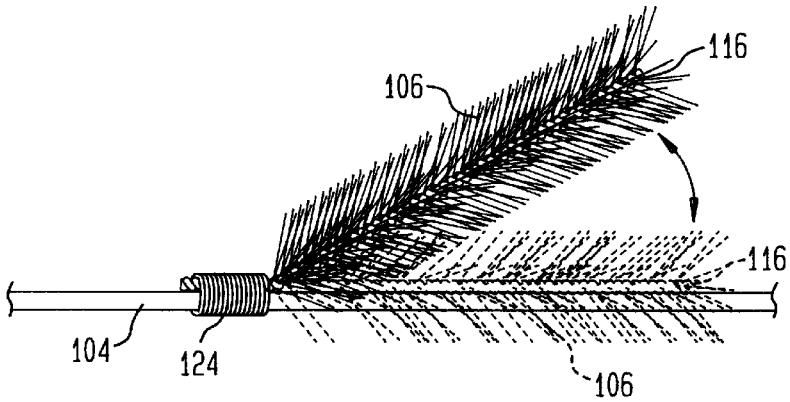

Turning now to FIG. 6, there is illustrated the unique features of the artificial leaves 106 in possessing shape memory characteristics. The artificial leaf 106 is shown, in solid lines, in its natural set up orientation attached to a branch 104. The angular relationship of the stem 116 to the branch 104 is created by the permanent bend 120. In its original angular orientation with respect to the branch 104, the artificial leaf 106 provides the artificial tree 100 with a natural and pleasing shape which is desired upon set up of the tree.

It is contemplated that during shipping or storage of the artificial tree 100, the individual artificial leaves 106 will be crushed or bent into a more compact orientation. By way of illustration, an artificial leaf 106 having been crushed or bent is illustrated in phantom located adjacent the branch 104. This distorted orientation of the artificial leaf 106 will be maintained as long as the artificial leaves are maintained under a crushing force as a result of its storage in a carton. However, upon removal of the branches 104 from their storage carton, the artificial leaves 106 due to the shape memory characteristics imparted by the stem 116 will return to their original manufactured orientation with respect to the branch 104. As previously described, the originally manufactured orientation will be based upon the angle of the permanent bend 120.

The artificial leaves 106, due to their shape memory characteristics, minimize the time and effort required in setting up the artificial tree 100 when removed from its storage container. In this regard, the artificial leaves 106 will automatically return to their original orientation which was preset at the time of manufacture. This eliminates the need to have the user manipulate each of the artificial leaves 106 into its proper orientation. Accordingly, an artificial tree may be set up by the user in a matter of minutes, as opposed to hours as was previously required.

Figure 7:
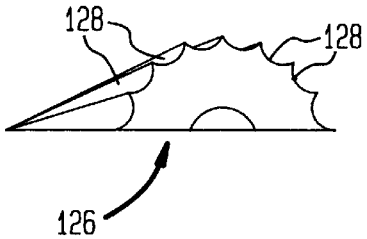
FIG. 7 is a perspective view of a fluted wedge operative for securing artificial leaves to a branch at predetermined angular orientations.

As previously described, the angular orientation of the artificial leaves 106 with respect to the branch 104 is provided by the permanent bend 120. In accordance with another embodiment of the present invention, artificial leaves 106 are provided without a permanent bend 120, while still retaining their shape memory characteristics. In this regard, the angular orientation between the artificial leaves 106 and the branch 104 may be established using a suitable guide. By way of example, with reference to FIG. 7, a wedge shaped guide 126 is provided with a plurality of elongated grooves 128 about its outer surface. The number of grooves and their particular angular orientation with respect to each other and a branch 104 may be varied as desired.

Figure 8:
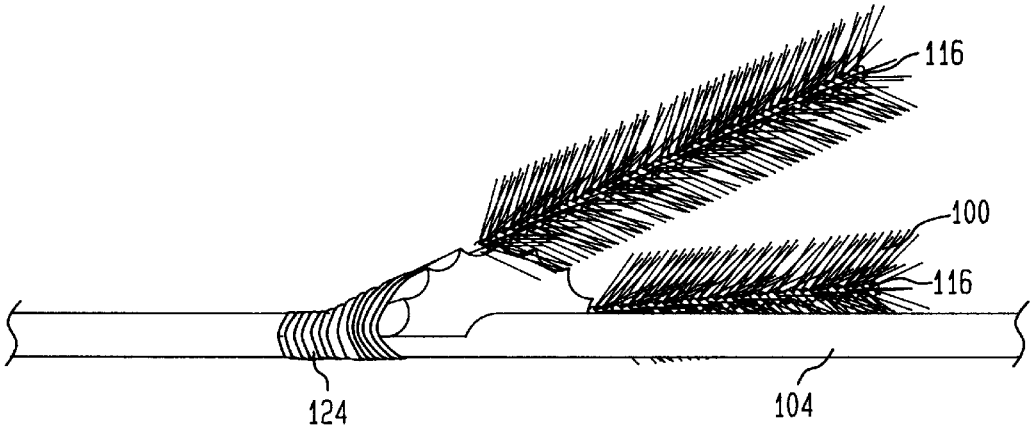
FIG. 8 is a front elevational view showing use of the fluted wedge in attaching artificial leaves to a branch.

Referring to FIG. 8, the wedge shaped guide 126 is positioned on a branch 104. A plurality of artificial leaves 106 are supported within one or more of the grooves 128. As the length of the guide 126 is substantially shorter than the overall length of the artificial leaves 106, a significant portion of the leaves extend outwardly therefrom at the angle established by the grooves. The guide 126 and plurality of artificial leaves 106 are attached to the branch 104 by means of wrapping 124 in the manner as previously described with respect to FIG. 5. In accordance with this embodiment, the angular orientation of the artificial leaves 106 with respect to a branch 104 is determined by the wedge shaped guide 126 as opposed to the permanent bend 120. In either case, due to the shape memory characteristics of the stem 116, the artificial leaf 106 will return to its original orientation even if crushed during storage in the manner as previously described.

Figure 9:
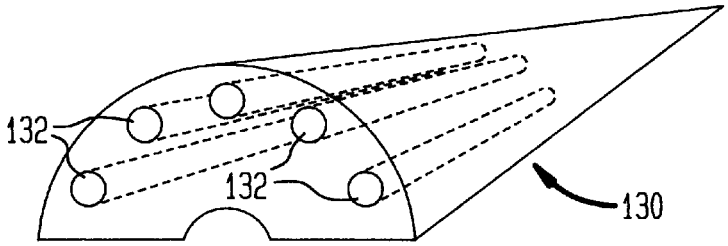
FIG. 9 is a perspective view of an apertured wedge for securing artificial leaves to a branch at predetermined angular orientations in accordance with another embodiment of the present invention.

Referring now to FIG. 9, there is disclosed a wedge shaped guide 130 in accordance with another embodiment of the present invention. In accordance with this embodiment, the guide 130 is provided with a plurality of openings 132 arranged at predetermined angles to provide the orientation for the artificial leaves 106 as required. The guide 130 is attached to a branch 140 also using the wrapping 124 in the manner previously described with respect to guide 126. The openings 132 may be arranged at the same angular relationship to the longitudinal axis of the branch 104 or may vary within the guide. In addition, any number of openings 132 may be provided within a single guide 126. Likewise, any number of guides 126, 130 may be attached to a branch 104 to provide the desired fullness for the artificial tree 100.

Figure 10:
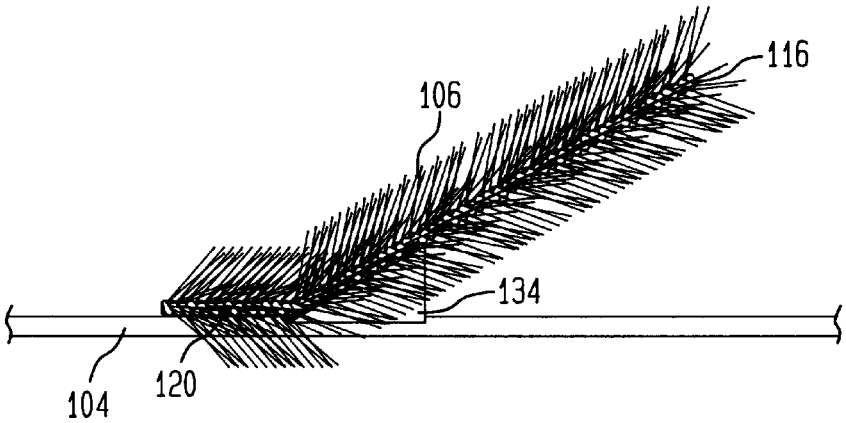
FIG. 10 is a front elevational view illustrating the use of a single wedge for attaching individual artificial leaves to a branch at a predetermined angular orientation in accordance with another embodiment of the present invention.

Referring now to FIG. 10, a wedge shaped guide 134 is disclosed in accordance with another embodiment of the present invention. The guide 134 is in the nature of a single guide adapted to support a single artificial leaf 106. The guide 134 is attached to the branch 104 also using the wrapping 124 (not shown) as previously described. The stem 116 may be provided with a permanent bend 120, if desired, to facilitate attaching of the leaf to the branch and for maintaining the proper original angular orientation.

The shape memory characteristics of the artificial leaves 106, as thus far described, results from the use of plastic material in forming the stem 116. It is also contemplated that the stem 116 of the artificial leaves 106 can be constructed from twisted or single wires made from spring steel which would also possess shape memory characteristics. The spring steel wires may have a suitable diameter range as already described with respect to those of plastic material. Spring steel is well known in the mechanical art and normally comprises high-carbon or alloyed types which are used in the manufacture of springs. Spring steel compositions are known from ASTM Designation Nos. A 417, A 401/A 401M, A231/A 231M, A 228/A 228M, A 679/A 679M. In the case of the use of spring steel, the permanent bend 120 could be provided, or the angular orientation could be attained by using the wedge shaped guides 126, 130, 134. Accordingly, it can be appreciated that other materials can be used in constructing the artificial leaf 106 having a stem 116 which includes shape memory characteristics.

Figure 11:
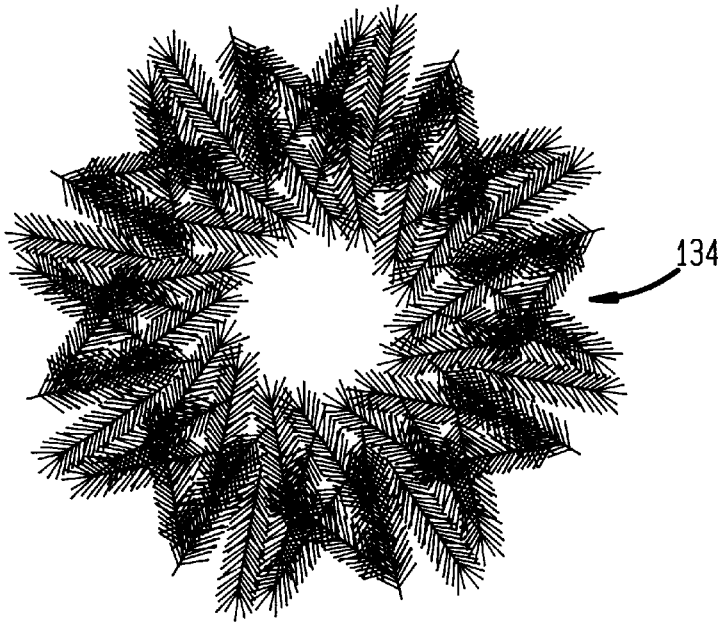
FIG. 11 is a front elevational view showing a wreath constructed from a plurality of artificial leaves in accordance with the present invention.

The present invention has generally been described with respect to the construction of artificial leaves 106 for use in the manufacture of artificial Christmas trees. However, it is to be understood that other artificial decorations such as wreathes 134 as shown in FIG. 11, flowers, garlands and the like which include artificial leaves 106 are within the scope of the present invention. Accordingly, it is possible to manufacture any number of artificial ornamental objects which include artificial leaves which have shape memory characteristics to facilitate their immediate setup upon removal from their shipping and/or storage cartons.

The artificial tree 100 may be constructed of the knock-down type. In this regard, the branches 104 may be removably inserted into a fixture which is mounted about the trunk 102 at various locations along its length. By way of example, suitable fixtures are known from Chase, U.S. Pat. No. 4,248,916; Huang, U.S. Pat. No. 4,496,615; and Whyte, U.S. Pat. No. 3,164,344. Additionally, the branches 104 may be inserted into openings (not shown) which are preformed in the trunk 102 at the desired angles along the length of and radial about the trunk.

Although the invention herein has been described with reference to particular embodiments, it is to be understood that the embodiments are merely illustrative of the principles and application of the present invention. For example, although the stem 116 has been described as being constructed from plastic or spring steel material, the stem can be constructed from the combination of these materials. In addition, a stem 116 of conventional construction can be used when combined with a wire of the present invention having shape memory characteristics. For example, a plastic wire could be laid against or otherwise attached to a conventional leaf stem such as by gluing to impart thereto the shape memory characteristics. It is therefore to be understood that numerous modifications may be made to the embodiments and that other arrangements may be devised without departing from the spirit and scope of the present invention as defined by the claims.

What is claimed is:

1. An artificial leaf for making artificial trees and wreathes therefrom, said leaf comprising an elongated stem of plastic material having shape memory characteristics, and a plurality of filaments attached to said stem along the length thereof, said stem having an angular orientation by having a bend therein at a predetermined angle along a portion thereof, said bend formed by heating said stem at the intended location of said bend to about the glass transition temperature of said plastic material and applying a sufficient force to said stem to cause said stem to bend thereat, whereby said shape memory characteristics enables said stem to return to said angular orientation after being deformed therefrom.

2. The artificial leaf of claim 1, wherein said stem comprises PVC material.

3. The artificial leaf of claim 1, wherein said stem is formed from a pair of twisted wires comprising plastic material.

4. The artificial leaf of claim 3, wherein said filaments are formed on either side of an elongated strip, said strip being twisted between said pair of wires.

5. The artificial leaf of claim 4, wherein said wires are positioned on either side of said strip prior to twisting said wires to form said elongated stem.

6. A branch for making artificial trees and wreathes therefrom, said branch comprising an elongated support member and a plurality of artificial leaves attached along the length of said support member, said artificial leaves comprising an elongated stem of metal material having shape memory characteristics, said stem arranged at a predetermined angular orientation with respect to said support member when attached thereto, and a plurality of filaments attached to said stem along the length thereof, whereby said shape memory characteristics enables said stem to return to said angular orientation after being bent therefrom.

7. A branch for making artificial trees and wreathes therefrom, said branch comprising an elongated support member and a plurality of artificial leaves attached along the length of said support member, said artificial leaves comprising an elongated stem of plastic material having shape memory characteristics, said stem arranged at a predetermined angular orientation with respect to said support member when attached thereto, and a plurality of filaments attached to said stem along the length thereof, whereby said shape memory characteristics enables said stem to return to said angular orientation after being bent therefrom.

8. The branch of claim 7, wherein said stem comprise PVC material.

9. The branch of claim 8, wherein said stem includes a bend along a portion thereof, said bend formed by heating said stem at the location of said bend to at least about the glass transition temperature of said plastic material and applying a sufficient force to said stem to cause said stem to bend thereat.

10. The branch of claim 7, wherein said stem is formed from a pair of twisted wires comprising plastic material.

11. The branch of claim 10, wherein said stem further includes a bend along a portion thereof.

12. The branch of claim 10, wherein said filaments are formed on either side of an elongated strip, said strip being twisted between said pair of wires.

13. The branch of claim 12, wherein said wires are positioned on either side of said strip prior to twisting said wires to form said elongated stem.

14. The branch of claim 6, wherein said stem comprises spring steel material.

15. The branch of claim 7, wherein said stem has an angular orientation by having a bend therein at a predetermined angle, whereby said shape memory characteristics enables said stem to return to its angular orientation after being bent therefrom.

16. The branch of claim 6, further including a wedge shaped member attached to said support member supporting said stem at a predetermined angle relative to the longitudinal axis of said support member.

17. The branch of claim 16, wherein said wedge shaped member includes at least one groove for supporting a portion of said stem therein at said predetermined angle.

18. The branch of claim 16, wherein said wedge shaped member includes a plurality of openings arranged at said predetermined angle, said stems of said artificial leaves received within said openings.

19. An artificial tree comprising an elongated trunk, a plurality of branches attached to said trunk along the length thereof, and a plurality of artificial leaves attached along the length of said branches, said artificial leaves comprising an elongated stem of plastic material having shape memory characteristics, said stem having an angular orientation by having a bend at a predetermined angle along a portion thereof, said bend formed by heating said stem at the intended location of said bend to about the glass transition temperature of said plastic material and applying a sufficient force to said stem to cause said stem to bend thereat, whereby said shape memory characteristics enables said stem to return to said angular orientation after being deformed therefrom and a plurality of filaments attached to said stem along the length thereof.

20. The artificial tree of claim 19, wherein said stem comprise PVC material.

21. The artificial tree of claim 19, wherein said stem is formed from a pair of twisted wires comprising plastic material.

22. The artificial tree of claim 21, wherein said filaments are formed on either side of an elongated strip, said strip being twisted between said pair of wires.

23. The artificial tree of claim 22, wherein said wires are positioned on either side of said strip prior to twisting said wires to form said elongated stem.

24. The artificial tree of claim 19, wherein said artificial tree comprises a Christmas tree.

25. The artificial tree of claim 19, wherein said plurality of branches are attached to said trunk.

26. An artificial tree comprising an elongated trunk, a plurality of branches comprising elongated support members attached to said trunk along the length thereof, and a plurality of artificial leaves attached along the length of said support members, said artificial leaves comprising an elongated stem having shape memory characteristics, a wedge shaped member attached to said support member supporting said stem at a predetermined angular orientation relative to the longitudinal axis of said support member and a plurality of filaments attached to said stem along the length thereof, whereby said shape memory characteristics enables said stem to return to said angular orientation after being deformed therefrom.

27. The artificial tree of claim 25, wherein said stem comprises PVC material.

28. The artificial tree of claim 26, wherein said wedge shaped member includes a plurality of openings arranged at said predetermined angular orientation, said stems of said artificial leaves received within said openings.

29. The artificial tree of claim 26, wherein said stem is formed from a pair of twisted wires comprising plastic material.

30. The artificial tree of claim 29, wherein said filaments are formed on either side of an elongated strip, said strip being twisted between said pair of wires.

31. The artificial tree of claim 30, wherein said wires are positioned on either side of said strip prior to twisting said wires to form said elongated stem.

32. The artificial tree of claim 26, wherein said artificial tree comprises a Christmas tree.

33. A plurality of branches for making artificial trees and wreathes therefrom, each said branch comprising an elongated support member and a plurality of artificial leaves attached along the length of said support member, said artificial leaves comprising an elongated stem of spring steel material having shape memory characteristics, said stem arranged at an angular orientation with respect to said support member when attached thereto, and a plurality of filaments attached to said stem along the length thereof, whereby said shape memory characteristics enables said stem to return to said angular orientation after being bent therefrom.

34. An artificial tree comprising an elongated trunk, a plurality of branches comprising elongated support members attached to said trunk along the length thereof, and a plurality of artificial leaves attached along the length of said support members, said artificial leaves comprising an elongated stem of plastic material having shape memory characteristics, a wedge shaped member attached to said support member supporting said stem at a predetermined angular orientation relative to the longitudinal axis of said support member and a plurality of filaments attached to said stem along the length thereof, whereby said shape memory characteristics enables said stem to return to said angular orientation after being deformed therefrom.

* * * * *

UNITED STATES PATENT AND TRADEMARK OFFICE

CERTIFICATE OF CORRECTION

PATENT NO. : 6,093,459
DATED : July 25, 2000
INVENTOR(S) : Puleo, Jr.

It is certified that error appears in the above-identified patent and that said Letters Patent is hereby corrected as shown below:

Column 10,
Lines 56, 57, after "claim" delete "25, wherein said stem comprises PVC material."
Lines 56, 57, after "claim" insert -- 26, wherein said wedge shaped member includes at least one groove for supporting a portion of said stem therein. --

Signed and Sealed this

Eleventh Day of September, 2001

*Attest:*

Nicholas P. Godici

NICHOLAS P. GODICI
*Acting Director of the United States Patent and Trademark Office*

*Attesting Officer*